United States Patent [19]

Forster et al.

[11] 3,980,469

[45] Sept. 14, 1976

[54] METHOD OF DESULFURIZATION OF A STEEL MELT

[75] Inventors: Eckehard Förster; Helmut Richter; Edgar Spetzler; Jochen Wendorff, all of Oberhausen; Wilhelm Klapdar, Essen; Heinrich-Wilhelm Rommerswinkel, Mulheim (Ruhr), all of Germany

[73] Assignee: Thyssen Niederrhein AG Hutten- und Walzwerke, Oberhausen, Germany

[22] Filed: Apr. 17, 1974

[21] Appl. No.: 461,714

[30] Foreign Application Priority Data

Apr. 28, 1973 Germany ..... 2321644

[52] U.S. Cl. ..... 75/49; 75/53; 75/58; 75/129

[51] Int. Cl.[2] ..... C21C 7/10; C22C 33/00

[58] Field of Search ..... 75/49, 53, 58, 129, 75/130, 130.5

[56] References Cited

UNITED STATES PATENTS

| | | | |
|---|---|---|---|
| 3,001,864 | 9/1961 | Muller | 75/130 R |
| 3,060,015 | 10/1962 | Spolders | 75/49 |
| 3,367,646 | 2/1968 | Robertson | 75/129 |
| 3,467,167 | 9/1969 | Mahin | 75/49 |
| 3,512,957 | 5/1970 | Brotzmann | 75/49 |
| 3,545,960 | 12/1970 | McClellan | 75/51 |
| 3,547,622 | 12/1970 | Hutchinson | 75/49 |
| 3,575,695 | 4/1971 | Miyashita | 75/51 |
| 3,598,383 | 8/1971 | Moore | 75/130 R |

*Primary Examiner*—P. D. Rosenberg
*Attorney, Agent, or Firm*—Karl F. Ross; Herbert Dubno

[57] ABSTRACT

A steel melt is confined and subjected to a partial vacuum. A particulate additive is entrained by a neutral nonreactive carrier gas and introduced into the melt below the surface thereof at a depth such that the additive is immediately vaporized and rises toward the surface of the melt in the form of bubbles which react with components of the melt. With particulate calcium as the additive an injection depth 1500 mm, a temperature of approximately 1500°C, and a vacuum of 20 Torr allows the sulfur content of a steel melt readily to be reduced below 0.005% by weight.

5 Claims, 3 Drawing Figures

METHOD OF DESULFURIZATION OF A STEEL MELT

CROSS REFERENCE TO RELATED APPLICATIONS

This application is related to the commonly assigned copending patent application Ser. No. 333,690 filed 20 Feb. 1973 for a METHOD AND APPARATUS FOR DESULFURIZATION OF A STEEL MELT.

FIELD OF THE INVENTION

The present invention relates to the introduction of particulate treatment additives into a steel melt and, more particularly, to a method of introducing a particulate additive, such as particulate calcium, into a steel melt for the desulfurization thereof.

BACKGROUND OF THE INVENTION

It is known to treat a steel melt by injecting into the molten mass of metal particulate additives which are entrained by a neutral (nonreactive) carrier gas such as argon. As a general rule this is carried out simply by blowing the particulate material through a lance into the melt whose upper surface is covered with slag exposed to the atmosphere at ambient pressure. The temperature at the outlet end of the introduction lance (i.e. the melt temperature) is sufficient to vaporize the particulate materials almost instantly thereby forming vapor bubbles which rise in the melt and react with the impurities or undesirable components of the melt. Due to the high specific gravity of the melt and the low density of the vapor large bubbles are formed whose collective interface between the vaporized additives and the steel melt determines the rate of reaction. When the additive is calcium for desulfurization of the melt, calcium oxide and calcium sulfide inhibit the reaction. In general the total interfacial surface area in low, the rate of reaction small and considerable quantities of the additive reach the surface unreacted.

The method of overcoming this in the past has so far been to inject the material as deeply as possible within the melt. Thus if the material is injected 1 or 2 meters or more below the surface of the melt, the rising bubbles have additional time to react more completely with the material of the melt. However, the injection of the calcium at such depths below the surface of the melt can inhibit its vaporization, since the hydrostatic pressure may exceed the vapor pressure at the melt temperature. Thus the calcium bubbles can form extremely slowly and only attain a size encouraging an efficient chemical reaction as the bubbles approach the upper surface of the melt. Pressurization of the melt, that is enclosing the melt and forming a superatmospheric pressure above it, has proven to be completely ineffective to overcome this disadvantage.

OBJECTS OF THE INVENTION

It is therefore an object of the present invention to provide an improved method of treating a steel melt.

Another object of this invention is the provision of an improved method of introducing a particulate additive into a steel melt.

Yet another object is to provide an improved system for introducing particulate calcium or the like into a steel melt for the desulfurization thereof.

It is also an object of the invention to provide an improved process for the desulfurization of steel with calcium whereby the aforementioned disadvantages are obviated.

SUMMARY OF THE INVENTION

These objects are attained according to the present invention by introducing the particulate additives into the melt below the surface thereof while maintaining the melt at least at its upper surface at subatmospheric pressure. More particularly the particulate material is entrained by an inert gas such as argon and the so entrained particulate material is blown into the melt at a level below the surface which allows immediate vaporization of the particulate material.

Thus according to the present invention the bubbles in the melt are able to attain a maximum size and a minimum internal pressure, thereby maximizing the chemical reaction between the vaporized particulate material and the steel melt which is at a temperature above the boiling point of the additive at the pressure with which it is injected into the melt.

According to the invention the treatment material is blown into the melt at a depth in which the thermodynamic parameters encouraging vaporization of this treatment additive are at a maximum. Thus the particulate material is introduced at the maximum depth possible, chosen however, such that the pressure is not so great as to preclude vaporization.

According to another feature of this invention there is provided on top of the melt a slag which absorbs all of the nongaseous reaction products. Thus it is possible to carry out the method according to the present invention in a conventional steel-smelting ladle which is so arranged that gas above it can be withdrawn so as to subject at least a portion of the steel melt to subatmospheric pressure of 20 Torr or less.

It is possible according to the present invention to use a one-or-two-riser gas-lift pump arrangement (or another vacuum lift melt treatment system) terminating above the melt in a treatment chamber which is closed and connected to a suction pump so as to maintain subatmospheric pressure in this chamber above the melt. The riser has its lower end below the surface of the melt, and the additive is introduced into the melt in this riser. Thus the rising bubbles in this riser serve as a pumping agent while the vaporized additive product reacts with the steel in the melt. In the case of a two-riser system the additive and its carrier gas are bubbled continuously into the ascending riser, so that there is created a continuous flow up the ascending riser and down the descending riser, with the steel melt being treated in the treatment chamber above the two risers and as it rises in the ascending riser. In a one-riser assembly the treatment chamber is raised and lowered periodically and only as it is being raised is the additive blown into the riser pipe. Thus a portion of the melt is treated, then discharged back into the melt, then as another portion is taken on it is treated and so on. In this system it is understood that the reference melt surface is that surface in the chamber.

In accordance with the present invention it has been found most advantageous to use calcium or calcium compounds in a finely divided state, and to inject them below the surface at a depth of between 1200 and 1800 mm, preferably 1500 mm, the gas pressure above the melt largely determining the introduction depth.

BRIEF DESCRIPTION OF THE DRAWING

The above and other objects, features, and advantages of the present invention will become more readily apparent from the following description, reference being made to the accompanying drawing in which.

SPECIFIC DESCRIPTION

Figure 1:
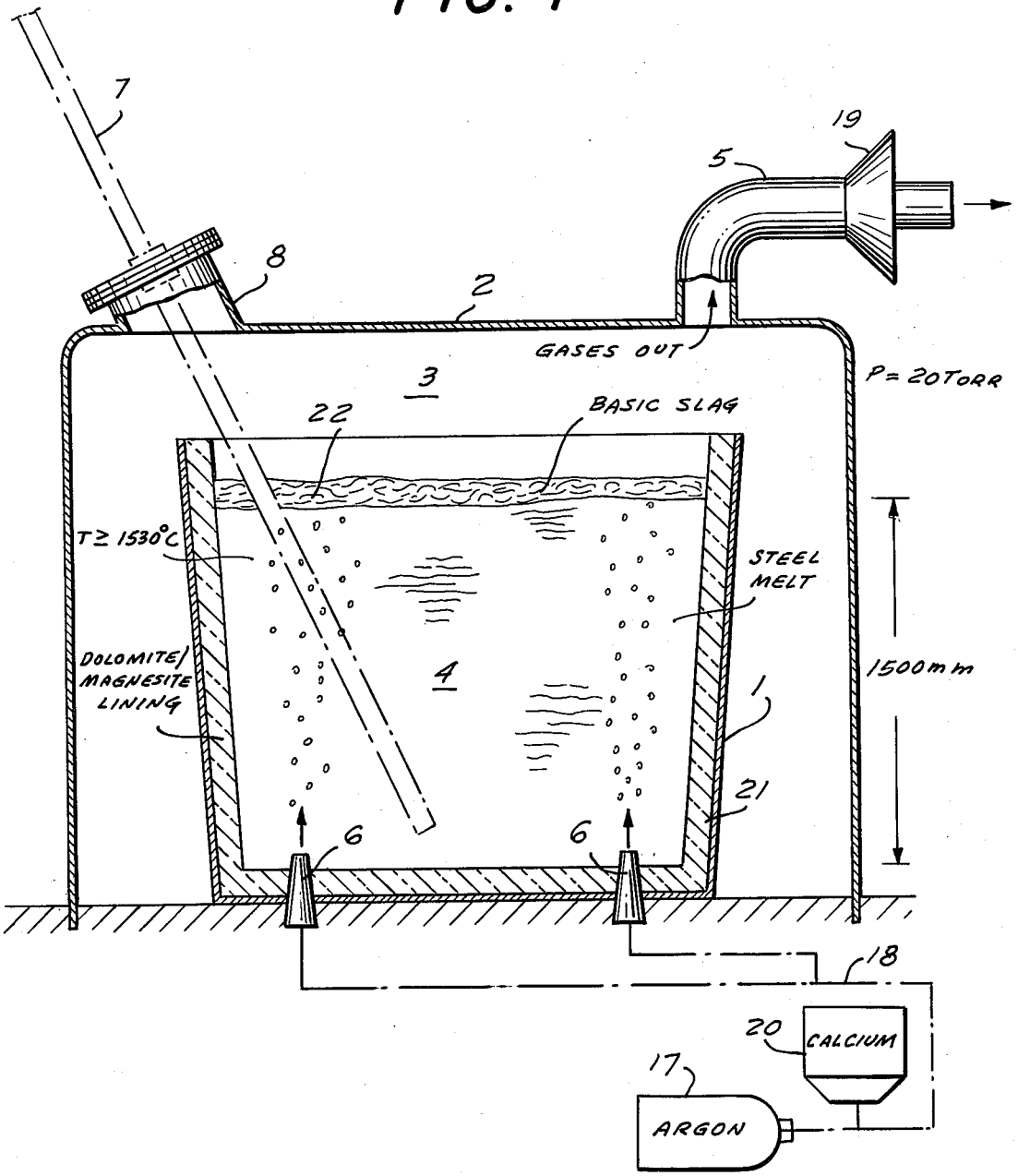
FIG. 1 is a vertical section through an apparatus for carrying out the method according to the present invention.

As is shown in FIG. 1 a ladle 1 provided with a dolomite/magnasite lining 21 as described in the above-cited copending application is filled with a deoxydized steel melt 4 covered with a basic slag 22. The entire ladle 1 with its melt 4 is enclosed in a chamber 2 defining a closed space 3 which is evacuated through an outlet pipe 5 by a pump 19 to have a subatmospheric pressure P. Argon from a bottle 17 and calcium from a hopper 20 are injected through a conduit 18 and a pair of nipples 6 into the very bottom of the melt 4 in the ladle 1. The melt is maintained at a temperature in excess of the vaporization temperature, 1170°C, of the calcium. Thus bubbles are formed in the melt of vaporized calcium which combines with any sulphur in the melt to form calcium sulfide.

Figure 2:
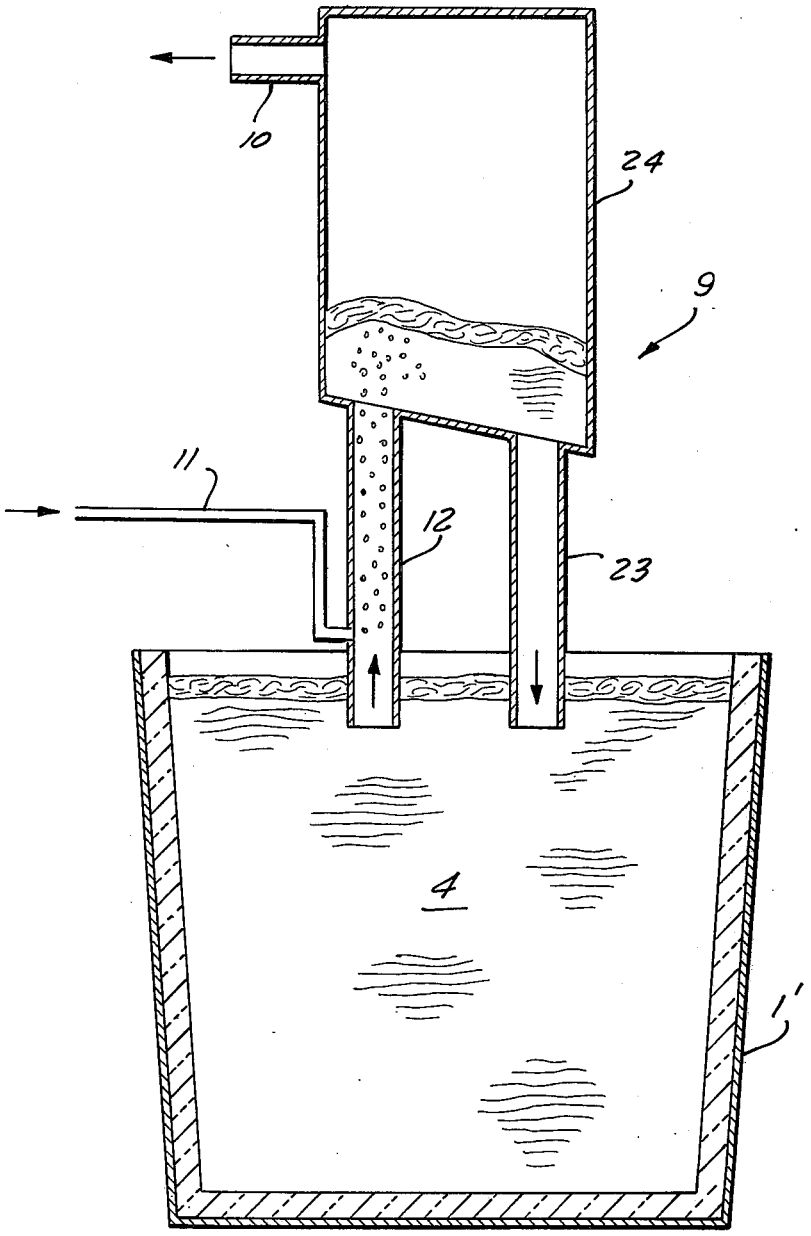
FIG. 2 is vertical section through another embodiment according to the invention utilizing two-riser gas-pump assembly.

FIG. 2 shows a similar ladle 1' holding a melt 4 and provided with a two-riser gas-pump arrangement 9 having an ascending riser pipe 12 and a descending riser pipe 23 terminating at their upper ends in a treatment chamber 24 and at their lower ends below the surface of the melt 4. A conduit 10 of a suction pump is connected to the treatment chamber 24 so as to create a substantial subatmospheric pressure therein. An inlet pipe 11 serves to inject particulate calcium entrained by neutral argon gas into the ascending riser 12 only slightly above the upper surface of the melt 4. Thus bubbles as shown rise in this pipe and draw the steel up out of the melt 4 to the chamber 24 while treating it, and then allowing it to descend in riser 23 back down into the melt 4.

Figure 3:
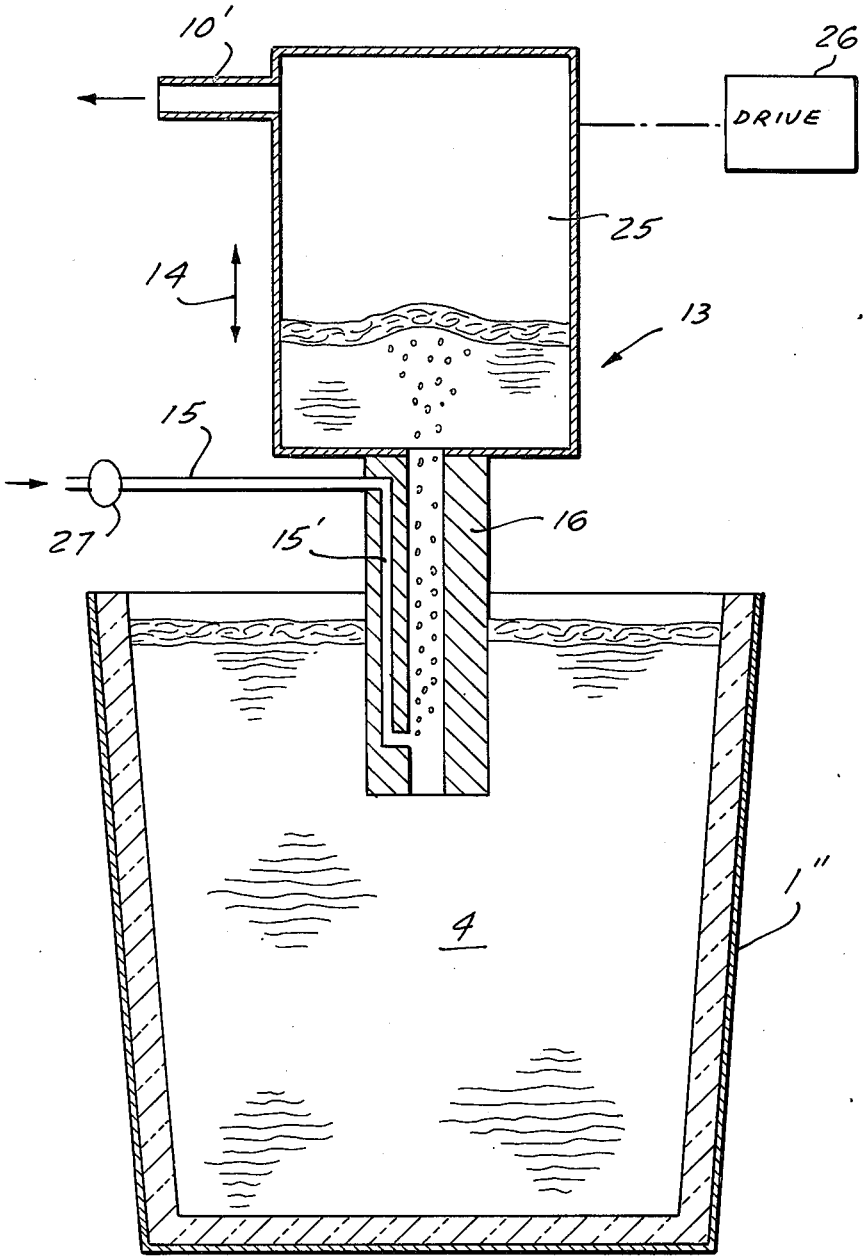
FIG. 3 is yet another arrangement in accordance with this invention using a one-riser assembly.

FIG. 3 shows a one-riser assembly used with a ladle 1'' and having a single riser 16 terminating at its lower end below the surface of the melt and its upper end in a treatment chamber 25 which is partially evacuated through a conduit 10'. A drive 26 is connected to the treatment chamber 25 so as to raise it and lower it as shown by arrow 14, always keeping the lower end of riser 16 below the surface of the melt 4. The riser 16 is of considerable wall thickness and is formed over most of its length with an integral passage 15' opening at its lower end inwardly into the melt and at its upper end into a conduit 15 which is supplied with argon-entrained particulate calcium. In this arrangement as the drive 26 raises the entire assembly a valve 27 in the conduit 15 is opened and when the drive 26 lowers the assembly this valve 27 is closed. Thus the vaporized calcium and argon only bubble up in the riser pipe 16 when the entire assembly 13 is lifted (see Die Edelstahlerzeugung, Leitner-Plöckinger, Springer Verlag; 1965, p. 793).

SPECIFIC EXAMPLES

Example A

The arrangement of the FIG. 1 is employed with a steel having an original sulfur content of approximately 0.035% by weight. The pump 19 is operated to reduce the pressure P in the chamber 2 to 20 Torr and the melt is held at a temperature T at least equal to 1530°C. Particulate calcium containing 30% by weight of calcium, 60% by weight silicon, and 10% by weight of iron and having a particle size between 25 and 150 microns is forced by the argon gas through the nipples 6 at a rate equal approximately to 4.4 kg of the additive per ton of steel. The distance between the top of the melt and the upper ends of the nipple 6 in this case was only 60 cm, but a reduction of the sulfur content to 0.005% by weight was obtained.

Example B

Under the same circumstances but using an injection depth of 1.5 m the sulfur content was reduced to 0.003% by weight.

By means of comparison an identical melt was treated at atmospheric pressure. When an injection depth of 60 cm was used the sulfur content could not be reduced in the same period of time below 0.025% by weight. Increase of the injection depth to 150 cm was only accomplished by a reduction of the sulfur content to 0.022% under the same circumstances. Finally when the injection depth was increased to 2750 cm the sulfur content could only be reduced to 0.010 to 0.015% by weight in the same period of time. Thus it should be clear that the method according to the present invention is surprisingly efficient and is capable of almost totally eliminating sulfur from a melt.

We claim:

1. A method of desulfurizing a ferrous melt comprising the steps of applying suction to the upper surface of said melt to subject it to subatmospheric pressure of substantially 15 to 25 Torr; simultaneously introducing a particulate additive consisting essentially of calcium and vaporizable at the temperature of said melt into said melt at a depth of substantially 1200 to 1800 mm below said surface thereof permitting vaporization of said additive; and vaporizing the introduced additive at the melt temperature while suction continues to be applied at said upper surface.

2. The method defined in claim 1, further comprising the step of entraining said additive with a carrier gas and introducing said additive into said melt by blowing same into said melt with said carrier gas.

3. The method defined in claim 1, further comprising the step of forming on said upper surface a slag and absorbing therewith nongaseous reaction products of said melt.

4. The method defined in claim 1 wherein said vacuum is formed by drawing a portion of said melt up through a riser tube into a treatment chamber through evacuation of said chamber, said additive being introduced into said melt in said riser.

5. The method defined in claim 4, further comprising the step of raising and lowering said treatment chamber and introducing said additive only during raising thereof.

* * * * *